United States Patent [19]

Shindo

[11] 4,442,663

[45] Apr. 17, 1984

[54] BELT-OPERATED FALSE-TWISTING UNIT

[75] Inventor: Noboru Shindo, Shiga, Japan

[73] Assignee: Murata Kikai Kabushiki Kaisha, Kyoto, Japan

[21] Appl. No.: 448,496

[22] Filed: Dec. 10, 1982

[30] Foreign Application Priority Data

Dec. 11, 1981 [JP] Japan ..... 56-200375

[51] Int. Cl.[3] ..... D01H 7/92; D02G 1/06

[52] U.S. Cl. ..... 57/336

[58] Field of Search ..... 57/332, 334, 336

[56] References Cited

U.S. PATENT DOCUMENTS 2,262,589 11/1941 Peck ..... 57/336 X 3,842,582 10/1974 Richter ..... 57/336

4,047,373 9/1977 Takai ..... 57/336

4,144,700 3/1979 Takai et al. ..... 57/336 X

*Primary Examiner*—Donald Watkins

*Attorney, Agent, or Firm*—Spensley, Horn, Jubas & Lubitz

[57] ABSTRACT

A belt-operated false-twisting unit having two endless belts extending across each other and urged against each other at the intersection. The belts are drivable to run in opposite direction for nipping a yarn at the intersection to false-twist the yarn. The belts and yarn guides are set to form a parallelogrammatic region in the intersection of the belts, where the yarn is nipped and false twisted.

4 Claims, 13 Drawing Figures

BELT-OPERATED FALSE-TWISTING UNIT

BACKGROUND OF THE INVENTION

The present invention relates to a belt-operated false-twisting unit.

There has been known a belt-operated false-twisting unit having two belts extending across each other and urged against each other at the intersection, the belts being drivable to run in opposite directions for nipping a yarn at the intersection to false-twist the yarn.

More specifically, as shown in FIG. 8, the two belts B1, B2 extend across each other at equal angles $\theta$ to a path of travel of a yarn Y to nip the yarn at the intersection to thereby false-twist the yarn. When the belts B1, B2 travel at the same speed, and the belts and the yarn run at a relative speed V, the speed V1 of travel of the belts in the direction of travel of the yarn is expressed as $V1=V \cos \theta$, and the yarn is fed along under a force proportional to the speed V1. The speed V2 of travel of the belts in a direction normal to the direction of feed of the yarn is given as $V2=V \sin \theta$, and the number of turns of twist is proportional to the speed V2. When the yarn is to be twisted, the force with which the yarn is urged to become untwisted should be overcome by another force which is determined by the nipping pressure given by the belts and the coefficient of friction between the belts and the yarn.

The force acting perpendicularly on the yarn, that is, the twisting force, the number of twists, the forces acting in the direction of travel of the yarn, that is, the feeding force and tensioning force, are naturally subjected to changes if the foregoing factors vary. However, the speed V of travel of the belts and the angle $\theta$ of intersection of the belts are normally set as fixed values during operation, and the selected nipping pressure by the belts and the coefficient of friction between the belts and the yarn will not vary to a great extent within a short period of time though they change somewhat with time. It follows therefore that the number of twists per unit length of the yarn, or the tensioning forces on the twisting and untwisting sides should remain substantially constant.

The actual yarn however is subjected to changes in the number of twists or the tensioning forces. Such variations in the number of twists or the tensioning forces are believed to be caused by displacement or vibration of the yarn in the lateral direction while the yarn is travelling, changes in the yarn nipping position due to movement of belts axially of pulley shafts, that is, changes in the length of the yarn being nipped. More specifically, the length l of the yarn Y being nipped in FIG. 8 is determined by the width L of the belts B1, B2 and the angle $\theta$, and can be defined as $l=L/\sin \theta$. When the yarn Y is displaced laterally to the left or right, or either the belt B1 or B2 is displaced in the axial direction of a pulley P1 or P2, the length of the yarn being nipped becomes smaller than the maximum length l of the yarn being nipped. At this time, the pressure under which the yarn is nipped between the belts tends to be reduced, and the belts and the yarn are liable to slip on each other, with the result that the twisting force and the yarn feeding force will be reduced.

To take the foregoing into account, it has been customary practice to place the yarn as half-twisted in a position displaced from the center of the intersection of the belts, and allow the yarn to the fully twisted position or the position in which the length of the yarn being nipped is at maximum as illustrated in FIg. 8. This indicates that the smaller the length of the yarn being nipped, the smaller the number of twists. Furthermore, as the force with which the yarn is fed in the direction of travel is reduced, the tension of the yarn on the untwisting side is increased.

The variations in the length of the yarn being nipped in the false-twisting unit during operation thereof largely affect the number of twists and the yarn tension, particularly on the untwisting side, with the consequences that ununiform false-twisted yarns will be produced and the quality of yarns produced is reduced.

SUMMARY OF THE INVENTION

It is an object of the present invention to eliminate the foregoing difficulties by preventing the length of the yarn being nipped even when the yarn is displaced more or less and the belts are moved. The present invention provides a belt-operated false-twisting unit having two belts which extend across each other to form an intersecting area having the shape of a parallelogram.

According to the present invention, the two belts extending across each other in a belt-operated false-twisting unit provide a parallelogrammatic region at their intersection for nipping yarns within such a region. The length of the yarn being nipped remains constant as long as the yarn is displaced within the confines of the parallelogrammatic region. Thus, the number of twists, and the yarn tensions on the twisting and untwisting sides do not undergo variations which would otherwise be caused by variations in the length of the yarn being nipped. Since the yarn is false-twisted under constant conditions, the number of twists given to the yarn per unit length thereof remains constant, and the bulkiness of the yarn as produced is rendered uniform throughout its length. Accordingly, the false-twisting unit of the invention can produce false-twisted yarns of good quality.

DETAILED DESCRIPTION OF THE INVENTION

Embodiments of the present invention will be described with reference to the drawings.

Figure 1:
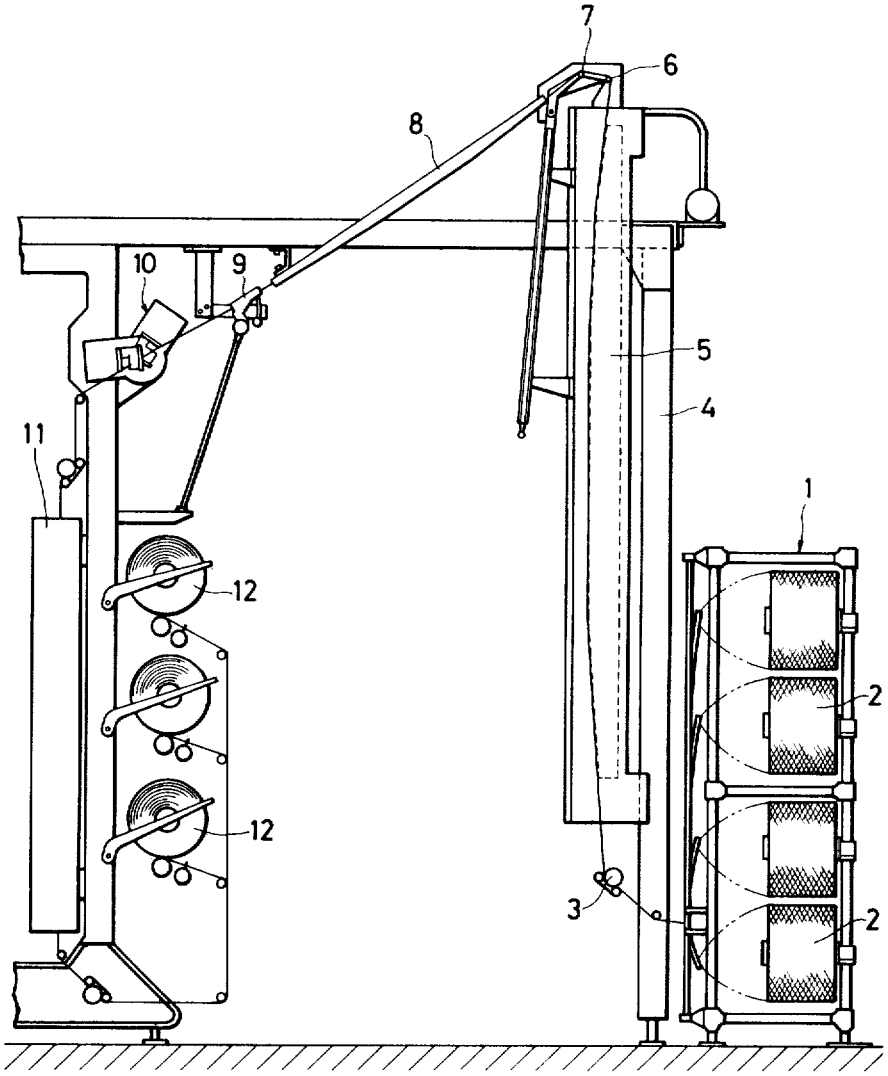
FIG. 1 is a side elevational view of a false twister.

FIG. 1 is a schematic diagram of a false-twister including a creel stand 1 on which a plurality of yarn supply bobbins 2 are supported. A yarn Y reeled out of the yarn supply bobbins 2 is fed by a feed roller 3, passes through a first heater 5 mounted on and extending along a post 4, travels around reversing guide rollers 6, 7 mounted above the first heater 5, and is introduced into an inclined balloon plate 8 which serves to suppress ballooning of the yarn due to twisting action. The yarn Y as it emerges from the balloon plate 8 passes through a cooling box 9 in which the yarn Y is positively cooled by water down to a predetermined temperature, and then is led into a false-twisting unit 10.

A false twist given by the false-twisting unit 10 is propagated to the yarn in the first heater 5 in which the twist is set. The yarn Y having passed through the false-twisting unit 10 is introduced into a torque-removing second heater 11 for producing a false-twisted yarn having a desired degree of crimp, which is then wound on packages 12.

Figure 2:
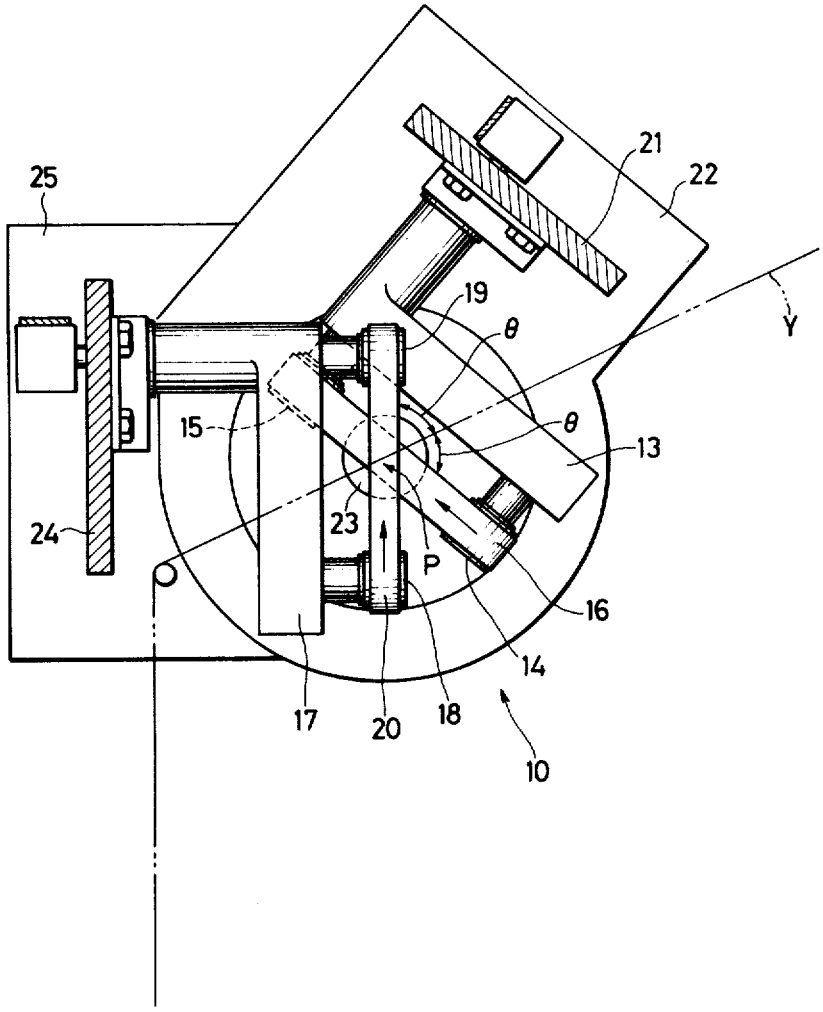
FIG. 2 is a side elevational view of a belt-operated false-twisting unit according to the present invention.

FIG. 2 shows a belt-operated false-twisting unit according to an embodiment of the present invention. The belt-operated false-twisting unit comprises a first endless belt 16 trained around pulleys 14, 15 mounted on a bracket 13 and a second endless belt 20 trained around pulleys 18, 19 mounted on a bracket 17, the first and second endless belts 16, 20 extending across each other each at an angle $\theta$ to a yarn Y. The endless belts 16, 20 are driven to run in opposite directions at the intersection for nipping the yarn therebetween under constant pressure to impose twisting and feeding forces on the yarn Y to false-twist the latter. The bracket 13 is fixed to a first frame 21 secured to a base 22 which is rotatable about a shaft 23. Likewise, the bracket 17 is fixed to a second frame 24 secured to a base 25 which is also rotatable about the shaft 23. The angle $\theta$ of intersection of the belts 22, 25 can therefore be adjusted by angularly moving the bases 22, 25.

Figure 3:
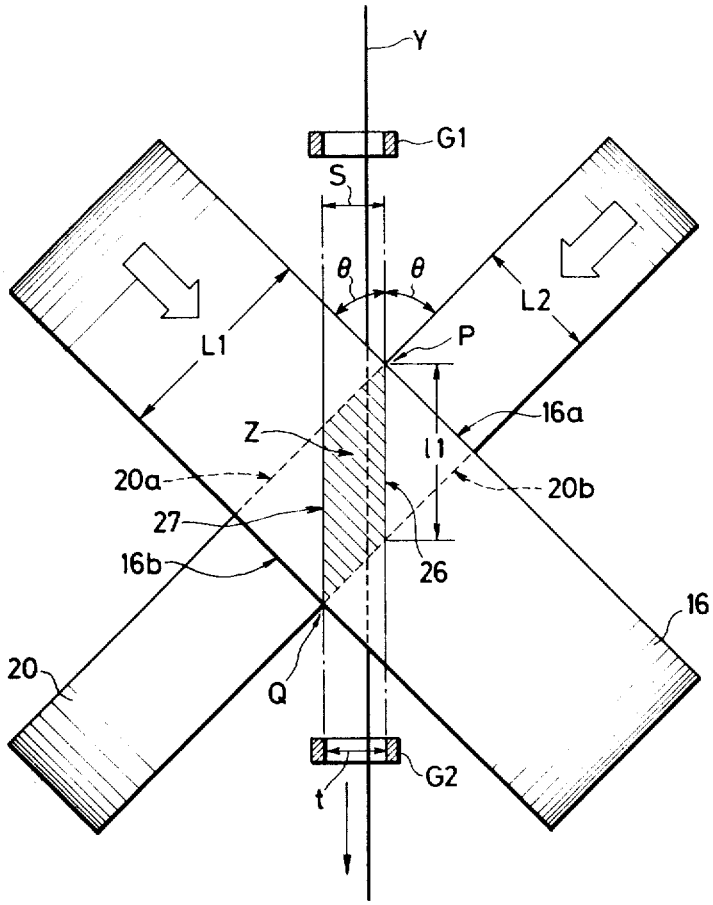
FIG. 3 is an enlarged plan view of an intersection of belts.

The first and second endless belts 16, 20 have different widths L1, L2, respectively, as shown in FIG. 3, the width L1 being larger than the width L2. The belts 16, 20 are inclined to intersect at the angle $\theta$ with respect to a straight line parallel to the path of travel of the yarn Y. An area which is defined by side edges 16*a*, 16*b* of the belt 16 and side edges 20*a*, 20*b* of the belt 20 is in the shape of a parallelogram, and an area which is defined by straight lines passing through points P, Q of intersection of the side edges of the belts 16, 20 parallel to the path of travel of the yarn Y and the side edges 20*a*, 20*b* of the belt 20 comprises a parallelogrammatic region Z. The length l of the yarn Y being nipped in a width S of the parallelogrammatic region Z remains constant and does not change anywhere within a width S of the parallelogrammatic region Z. More specifically, where the first and second endless belts 16, 20 have respective widths L1, L2 and extend at the angle $\theta$ with respect to the path of travel of the yarn Y, the width S of the parallelogrammatic region Z and the length l1 of the yarn being nipped within the width S can be expressed as follows:

$$S=(L1-L2)/2\cos\theta$$

$$l1=L2/\sin\theta$$

When L1 = 12 mm, L2 = 8 mm, and $\theta=55°$, then S = 3.5 mm, and l1 = 9.8 mm. Under this condition, the length l1 of the yarn being nipped remains unchanged even when the path of travel of the yarn Y is displaced 3.5/2 mm laterally from the center of the parallelogrammatic region Z. Therefore, as long as the relative positional relationship between the yarn Y and the intersection of the belts varies within the confines of the parallelogrammatic region Z, the length l1 of the yarn being nipped remains constant, and the number of twists and the yarn tension are not affected to a large degree. Designated in FIG. 3 at G1, G2 are yarn guides having yarn passage holes of a width t smaller than the width S and positioned in alignment with the parallelogrammatic region Z for guiding the yarn.

Experiments on variations in the number of counts and the yarn tension for belts having equal widths and different widths will now be described.

Figure 4:
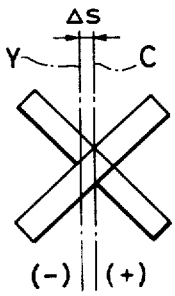
FIG. 4 is a diagram illustrative of an amount of displacement of a yarn path.

In FIG. 4, the yarn is assumed to be displaced in the negative direction when it is displaced to the left from the center C of nipping action, and in the positive direction when displaced to the right, the amount of displacement being denoted by $\Delta S$.

Figure 5:
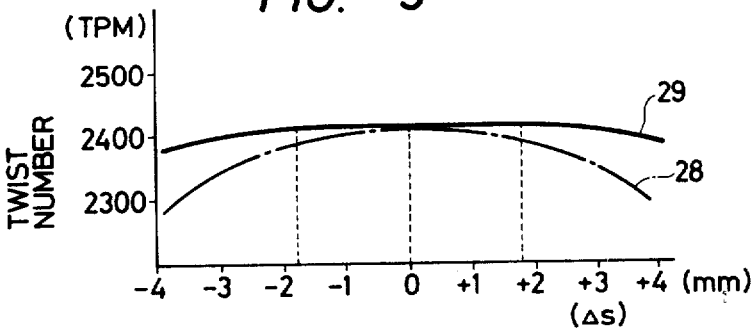
FIG. 5 is a graph showing the relationship between amounts of displacement of a yarn path and variations in the number of twists.
Figure 6:
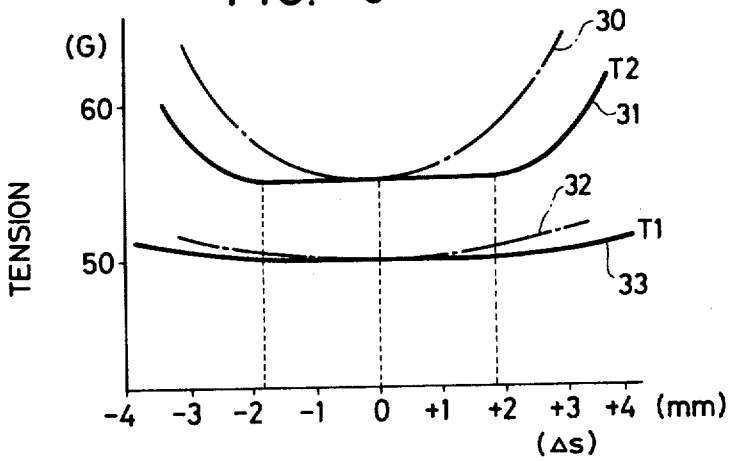
FIG. 6 is a graph showing the relationship between amounts of displacement and yarn tensions.

FIGS. 5 and 6 illustrate results of experiments conducted with the nipping force being 250 g, the yarn speed 600 m/min., the belt speed 800 m/min., the angle $\theta=55°$, a polyester yarn of 225 denier, the width L1 = 12 mm, the width L2 = 8 mm.

FIG. 5 shows the relationship between the amount $\Delta S$ of displacement of the yarn and the number of twists (TPM). The curve shown in the dot-and-dash-line curve 28 is indicative of the relationship given by belts having the same widths (8 mm, 8 mm), and the solid-line curve 29 is indicative of the relationship given by the belts according to the present invention. With the belts of the same widths, the number of twists is reduced when the yarn is displaced slightly laterally from the center (0 position) of intersection of the belts. The number of twists is actually reduced by 100 TPM at a position displaced 4 mm from the center. With the belts of the different widths, however, the number of twists remains substantially constant before the amount of yarn displacement exceeds the value S = 3.5, that is, $\Delta S=\pm 3.5/2$, and the number of twists starts to be reduced when the amount of yarn displacement exceeds $\pm 3.5/2$. Therefore, the displacement of the yarn path within the parallelogrammatic region Z at the intersection of the belts does not substantially affect the number of twists of the yarn.

FIG. 6 is illustrative of the relationship between the amount $\Delta S$ of displacement of the yarn path and yarn tensions T1, T2. The curves shown in the dot-and-dash lines indicate tension variations given by the belts of the same widths, and the curves in the solid lines indicate tension variations given by the belts of the different widths. The two upper curves 30. 31 in the dot-and-dash line and the solid line, respectively, in FIG. 6 show the yarn tension T2 on the untwisting side, and the two lower curves 32, 33 show the yarn tension on the twisting side.

By the yarn tension on the untwisting side is meant a tension imposed on the yarn below the yarn nipping region where the yarn travels downwardly in FIG. 3, and by the yarn tension on the twisting side is meant a tension imposed on the yarn above the yarn nipping region for the downward yarn travel. The yarn tension T1 on the twisting side is not subjected to a large variation when the yarn is displaced from the center of intersection of the yarn, and is substantially 50 g under the foregoing conditions. With the belts of the same widths, the tension varies immediately when the yarn is displaced slightly laterally from the center of the yarn nipping region even if such tension variations are small. With the present invention, substantially no tension variation occurs when the yarn is displaced within the parallelogrammatic region Z at the intersection of the belts, that is, S=3.5 mm.

The foregoing condition manifests itself particularly with respect to the tension variations on the untwisting side. More specifically, as shown in FIG. 6, where the belts have the same width, the tension T2 on the untwisting side becomes increased when the yarn is slightly displaced from the center of intersection of the yarns, that is, the untwisting yarn tension is subjected to variations when the yarn is caused to vibrate slightly, with the result that the false-twisted yarn as fabricated tends to become irregular in quality. Stated otherwise, the yarn and the belts slip on each other due to variations in the length of the yarn being nipped, and as a result the force for feeding out the yarn is reduced, thus lowering the speed of feed of the yarn from the false-twisting unit. Therefore, the yarn undergoes a new tension due to interaction with the feed roller which rotates at a constant speed, resulting in an increased yarn tension on the untwisting side.

With the belts according to the present invention, substantially no variation takes place in the yarn tension T2 on the untwisting side within the parallelogrammatic region (S=3.5 mm) even when the yarn path is laterally displaced from the center of intersection of the belts, as illustrated by the solid-line curve 33 in FIG. 6. The yarn tension tends to increase only when the yarn is displaced out of the region Z, and increase largely when the yarn displacement exceeds ±2 mm. The amount ΔS of displacement can easily be held within 4 mm by the yarn guides positioned upwardly and downwardly of the nipping region. Thus, the yarn even when it is displaced can be confined within the parallelogrammatic region, and can be subjected to a substantially constant tension.

Figure 7:
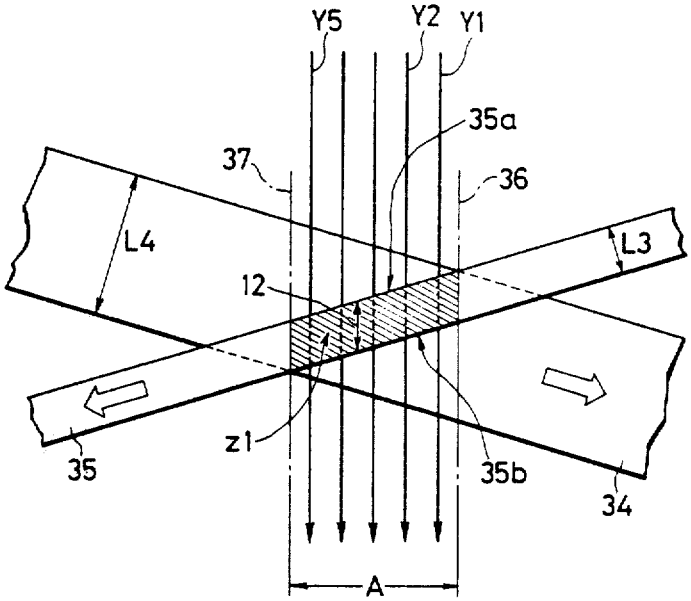
FIG. 7 is an enlarged plan view of an intersection of belts in a belt-operated false-twisting unit according to another embodiment.
Figure 8:
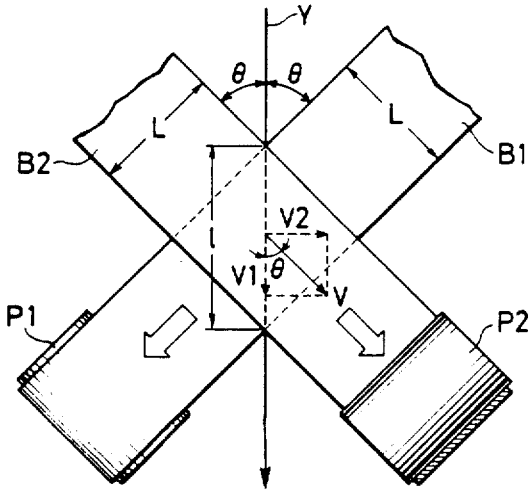
FIG. 8. PRIOR ART
FIG. 8 is a plan view of an intersection of conventional belts.

As is apparent from the foregoing experiments, the parallelogrammatic region Z at the intersection of the belts provides a range in which the length of the yarn being nipped is kept constant. Within such a range, the number of twists, and the yarn tensions on the twisting and untwisting sides remain unchanged even when the yarn path is displaced, so that the yarn can be false-twisted stably.

Where two belts 34, 35 have widely different widths L3, L4 as shown in FIG. 7, a parallelogrammatic region Z1 defined by straight lines 36, 37 parallel to the path of travel of the yarn and side edges 35*a*, 35*b* of the belt 35 is narrower at the intersection of the belts 34, 35, an arrangement which is capable of nipping a plurality of yarns Y1 through Y5 in the region Z1. Accordingly, a plurality of yarns can be effectively false-twisted at the same time by the pair of belts. The yarns as false-twisted simultaneously by the pair of belts have equalized qualities and are better in quality as the length l2 of the yarn being nipped tends to remain unchanged.

Figure 9:
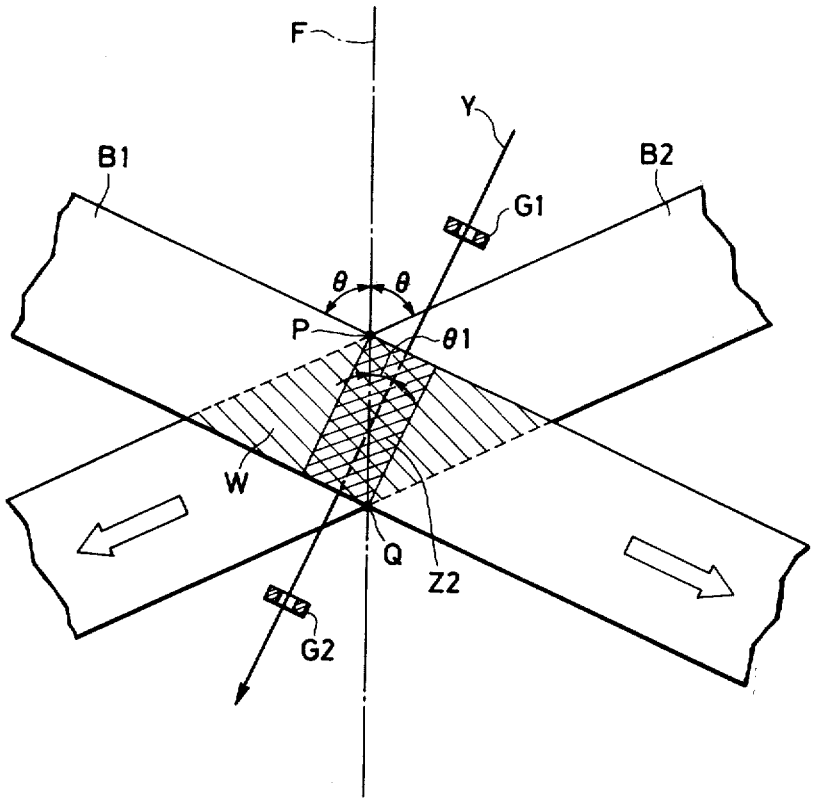
FIG. 9 is an enlarged plan view of an intersection of belts showing another embodiment.
Figure 10:
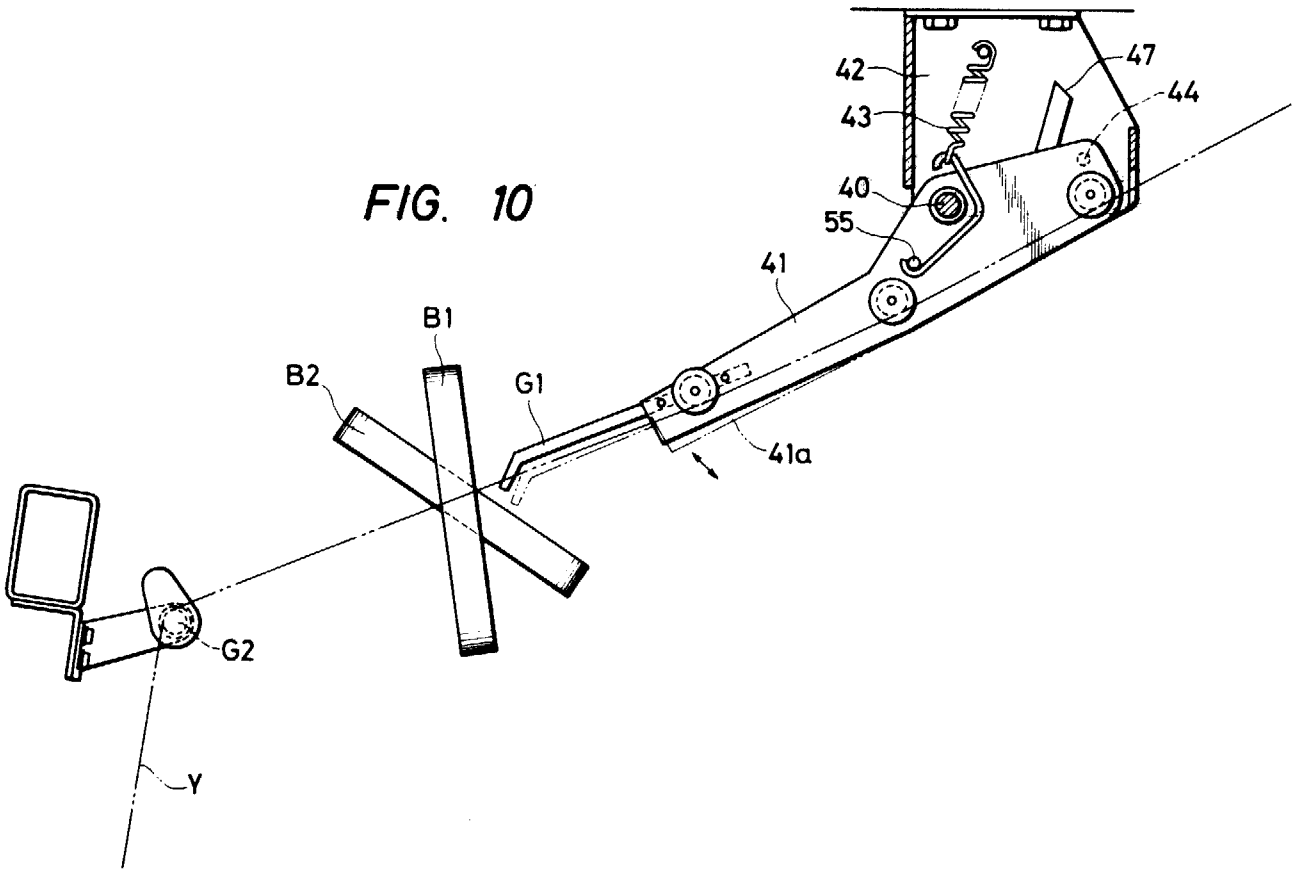
FIG. 10 is a side elevational view showing an adjusting device for positioning a yarn guide.
Figure 11:
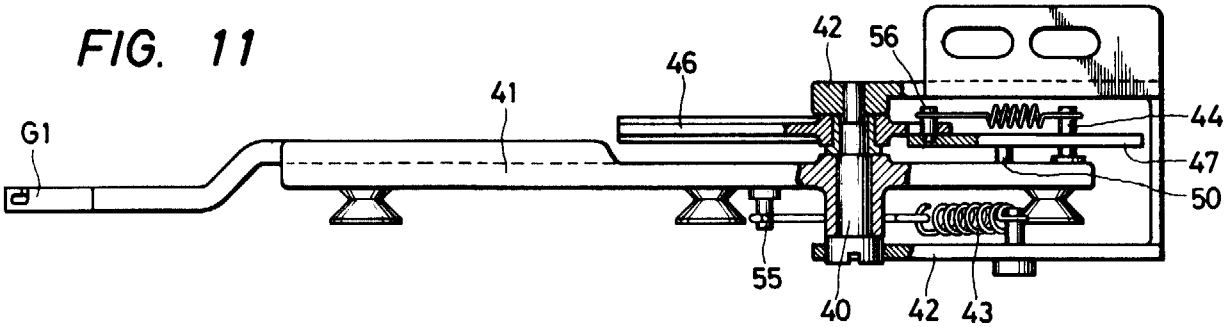
FIG. 11 is a plan view of the adjusting device in FIG. 10.
Figure 13:
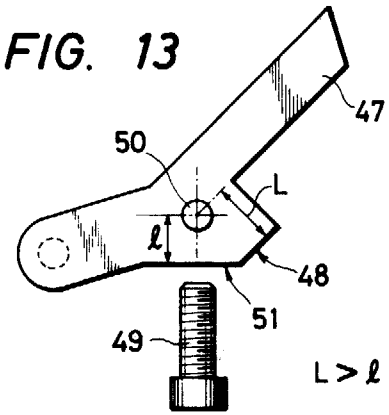
FIG. 13 is a enlarged view showing a cam lever and a bolt in FIG. 12.

In the above embodiments, belt-operated false-twisting units in which the belts have different width are described. The object of the present invention, however, can be accomplished when the belts having same width are applied to the false-twisting apparatus. As shown in FIG. 9, the belts B1, B2 having the same width are inclined to intersect at the angle $\theta$ with respect to a fictitious line F and a line passing through the centers of the yarn guides G1, G2, that is, the yarn passage Y are set to intersect at an angle $\theta 1$ with respect to the fictitious line F. The $\theta 1$ is selected to be in the range of $\theta 1 < \theta$.

An area which is defined by straight lines passing through points P, Q of intersection of the side edges of the belts B1, B2 parallel to the line passing though the centers of the yarn guides G1, G2 and is included in the intersecting area W of the belts B1, B2 comprises a parallelogrammatic region Z2. In this embodiment, the length l of the yarn Y being nipped in the parallelogrammatic region Z2 also remains constant and does not change if the yarn passage Y is displaced parallel to the line passing through the centers of the yarn guides G1, G2.

Figure 12:
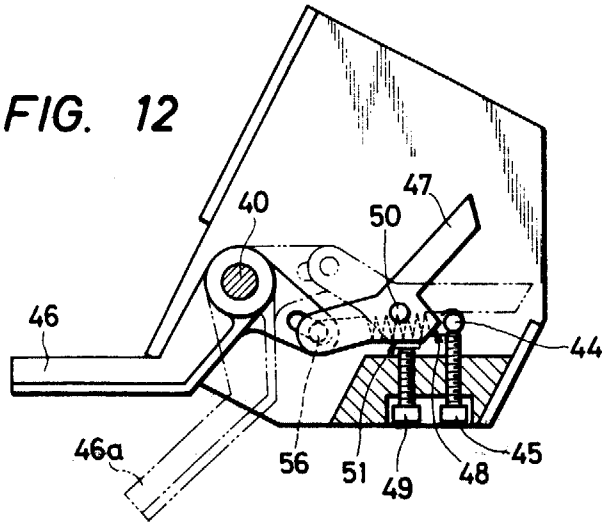
FIG. 12 is a diagram illustrative of a part of the device in FIG. 11.

Referring to FIGS. 10 through 13, an adjusting device for positioning the yarn guides G1, G2 will be illustrated hereinafter. The guide G1 which is arranged at one side of the nip portion of the belts is mounted rotatably about a stationary shaft 40. A lever 41 having the guide G1 at the top end thereof is swingable around the shaft 40 and a spring 43 is spread between a stationary bracket 42 and a pin 55 fixed on the lever 41 to urge the lever 41 in the clockwise direction around the shaft 40 to the position shown in FIG. 10. The lever 41 is positioned by becoming to abut a pin 44 secured at the rear end of the lever 41 against a bolt 45 screwed into the bracket 42 as shown in FIG. 12. Accordingly, the position of the lever 41 can be changed by adjusting the length of the protruding part of the bolt 45 from the bracket 42. That is, the yarn passage Y at the nip portion of the belts may be displaced by changing the position of the guide G1 provided on the lever 41. A lever 46 is to locate the guide G1 at the half-twisting position. To prevent yarn breakage at the starting operation of the false-twisting, the yarn is placed at the half-twisting position displaced from the center of the intersection of the belts and then the yarn is guided to the fully twisted position by moving the guide G1 when the yarn running speed is increased to the normal speed.

When the lever 46 is located at the position shown by the two-dots-and-dash line in FIG. 12, a can face 48 of a cam lever 46 connected with the lever 46*a* by a pin 56 comes to abut against the bolt 49. The lever 41 is located at the position 41*a* shown by the two-dots-and-dash line in FIG. 10 because the cam lever 47 is pivoted by a pin 50 on the lever 41. At this position there is a clearance between the pin 44 and bolt 45. When the yarn running speed is increased to the normal operating speed, the lever 46*a* is rotated to the position 46 shown by the solid line and then the cam face 48 of the cam lever 47 leaves the bolt 49 to rotate the lever 41 in the clockwise direction around the shaft 40 by the urging force of the spring 43. So, the lever 41 is arranged at the position shown by the solid line in FIG. 10. Then, the pin 44 of the lever 41 comes to abut against the bolt 45 and the lever 41 is set up to position the guide G1 relating to the nip portion of the belts.

A distance A between the cam face 48 and the shaft 50 and a distance a between a cam face 51 and the shaft are defined as A>a. When the cam face 48 abuts against the bolt 49, the pin 44 becomes disjoined from the bolt 45. While, when the cam face 48 separates from the bolt 49 and the cam face 51 comes to be near the bolt 49, the pin 44 comes to abut against the bolt 45.

Accordingly, the position of the guide G1 at the normal false-twisting operation can be freely selected and changed by adjusting the length of the protruding part of the bolt 45. Thus the parallelogrammatic region Z2 where the nip length of the yarn is retained at constant regardless of displacement of the yarn passage may be formed in the intersecting range W of the two belts B1, B2 having the same width.

The guide G2 should be adjusted in the setting position thereof in the relation to the position of the guide G1. The parallelogrammatic region Z2 may be formed by moving the guide G1 appropriately even if the guide G2 is fixed at the position shown in FIG. 9.

What is claimed is:

1. A belt-operated false-twisting unit comprising two endless belts extending across each other and drivable to run in opposite directions at the intersection for nipping a yarn between the two belts to false-twist the yarn, characterized in that a yarn nipping portion comprises a parallelogrammatic region which is included in the intersecting area of the endless belts and is defined by two straight lines passing through points of intersection of the side edges of the belts and parallel to a line passing through the centers of yarn passage holes of yarn guides arranged at both sides of the intersecting area along the path of travel of the yarn.

2. A belt-operated false-twisting unit as claimed in claim 1, wherein said yarn passage holes of the yarn guides have widths smaller than the width of the parallelogrammatic region at the intersection of the belts.

3. A belt-operated false-twisting unit as claimed in claim 1, wherein said first and second endless belts having different widths respectively are inclined to intersect at a certain angle with respect to a straight line parallel to the path of travel of the yarn.

4. A belt-operated false-twisting unit as claimed in claim 3, wherein the first endless belt is trained around pulleys mounted on a bracket secured on a first base and the second endless belt is trained around pulleys mounted on a bracket secured on a second base, said first and second bases being rotatable about a shaft respectively so that the angle of the intersection of the belts can be adjusted by angularly moving the bases.

* * * * *